US006285322B1

(12) United States Patent
Johannisson et al.

(10) Patent No.: US 6,285,322 B1
(45) Date of Patent: Sep. 4, 2001

(54) ELECTRONICS UNIT FOR WIRELESS TRANSFER OF SIGNALS

(75) Inventors: Björn Johannisson, Kungsbacka; Mats Högberg, Göteborg, both of (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/002,369

(22) Filed: Jan. 2, 1998

(30) Foreign Application Priority Data

Jan. 3, 1997 (SE) ..... 9700029

(51) Int. Cl.[7] ..... H01Q 1/38

(52) U.S. Cl. ..... 343/700 MS; 343/853; 343/893

(58) Field of Search ..... 343/700 MS, 767, 343/816, 835, 853, 895, 893; H01Q 1/38

(56) References Cited

U.S. PATENT DOCUMENTS 5,572,172 * 11/1996 Standke et al. ..... 333/128
5,818,390 * 10/1998 Hill ..... 343/700 MS
5,838,285 * 11/1998 Tay et al. ..... 343/895
5,907,305 * 5/1999 Epp et al. ..... 343/700 MS

FOREIGN PATENT DOCUMENTS 0 492 010 12/1990 (EP) .
2 248 344 9/1990 (GB) .
08204432 * 8/1996 (JP) ..... H01Q/7/00
94/28595 12/1994 (WO) .

* cited by examiner

*Primary Examiner*—Don Wong
*Assistant Examiner*—Shih-Chao Chen
(74) *Attorney, Agent, or Firm*—Burns, Doane, Swecker & Mathis, L.L.P.

(57) ABSTRACT

An electronics unit for wireless transfer of signals, includes an antenna part, an electronics part, and a transmission circuit part. The electronics part is placed on a laminate with at least one substrate layer of a dielectric material. The substrate layer is made of a flexible material and forms a continuous unit, including a first part which supports the electronics part, a second part which supports the antenna part, and a third part which supports the transmission circuit part. The second part of the substrate is formed to shape a convex surface, which supports groups of at least one antenna element. Since the surface is curved, the groups cover different directions.

11 Claims, 4 Drawing Sheets

ELECTRONICS UNIT FOR WIRELESS TRANSFER OF SIGNALS

TECHNICAL FIELD

The present invention relates to an electronics unit for wireless transfer of signals, which comprises an antenna part, transmission circuits and an electronics part. The unit is based on a laminate with a substrate layer of a dielectric material.

BACKGROUND OF THE INVENTION

When transferring signals by means of electromagnetic waves at high frequencies, to be more exact within the microwave area, microstrip technology is used both for the antenna part and the electronics part. Microstrip technology is a microwave technology which is based on laminates of two electrically conducting layers, and an intermediate dielectric layer. This dielectric layer is also called substrate, and serves not only as an isolating layer, but also as mechanical support for the electrically conducting layers. Previously known electronics units for the transfer of signals within a large angle divided into sectors consist of a separate electronics part and a separate antenna part, between which there are transmission circuits in the form of conventional cables. These are connected to each part by means of soldering or connectors. This previously known technology is expensive, and demands a great deal of space, and can cause interruptions in operation due to manufacturing errors, ageing, etc.

SUMMARY OF THE INVENTION

The object of the present invention is to obtain an electronics unit which is simple, cost efficient, saves space and provides good characteristics, since the invention solves the interface problems between the antenna part and the electronics part.

The said object is achieved by means of an electronics unit according to the present invention. This is characterized by a construction with substrate layers which are divided into three continuous sections, which are a first section which is part of the electronics part, a second section which forms the substrate in the antenna part, and a third section which supports the transmission circuits. The substrate extends continuously between the three sections, and is made of a flexible material, and is in the third section bent to a curved form. Its convex surface supports radiation elements, the beams of which, due to the bent surface, point in different directions.

Due to the construction according to the invention, an integrated unit is obtained with one and the same construction, and without intermediate organs such as solderings or connectors.

BRIEF DESCRIPTION OF THE DRAWINGS

The invention will in the following be described in closer detail using an example of an embodiment with reference to the appended drawings, in which.

DETAILED DESCRIPTION

Figure 1:
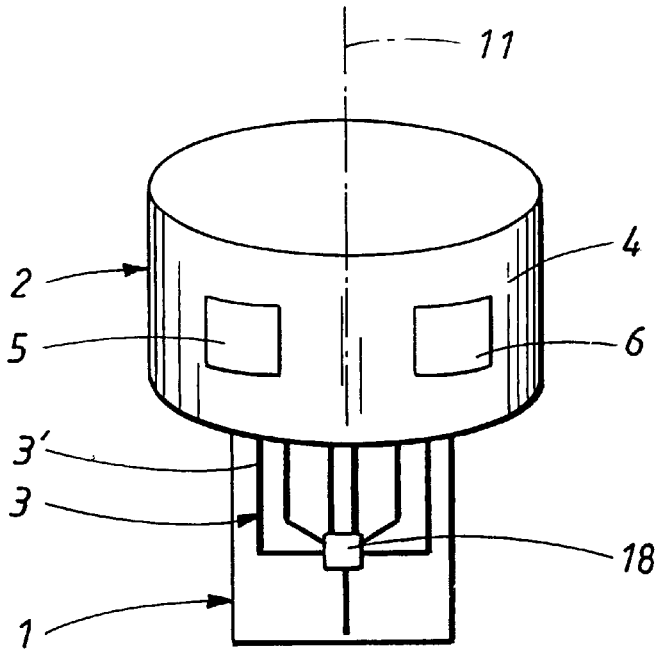
FIGS. 1 and 2 show different perspective views of the electronics unit in one example of an embodiment.
Figure 2:
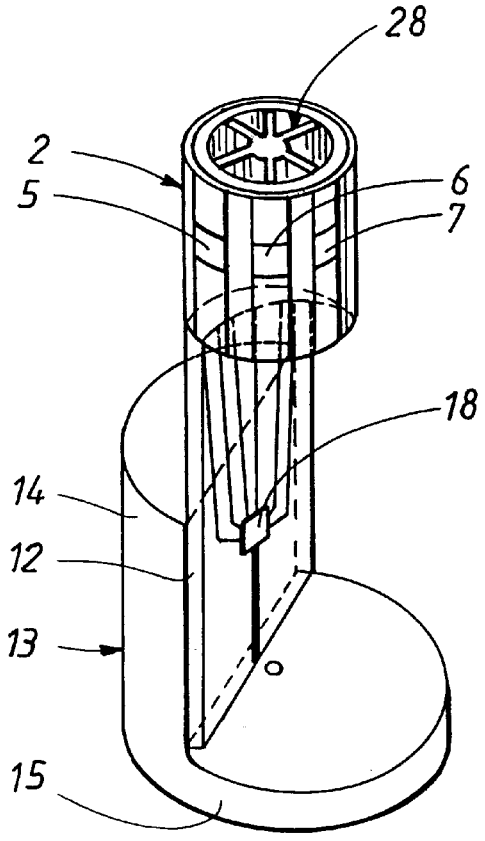

As can best be seen in FIGS. 1 and 2, the antenna unit according to the invention consists of an electronics part 1, an antenna part 2, and a transmission circuit part 3 with transmission circuits 3 which form the interface between the electronics part and the antenna part. According to the invention, both the electronics part 1, the antenna part 2, and the transmission circuit part 3 are designed using the same construction, i.e. microstrip technology with a supporting structure, which according to the invention is a substrate which is common to both the electronics part 1, the antenna part 2 and the transmission circuit part 3. The antenna part 2 is of the conformal sector antenna kind, with a plurality of evenly spaced antenna elements 5, 6, 7, 8, 9, 10 around a cylinder 4, see also FIG. 5. The antenna is of the so-called multi-sector antenna kind, i.e. the antenna elements are so positioned that they together have a directivity in several (in the example shown, all) directions as seen in a plane which is perpendicular to the longitudinal axis 11 of the cylinder formed.

The electronics part 1 is in the example shown supported by a substrate 12, which in connection to the electronics part preferably is plane, and also by a massive supporting structure 13 of metal which forms a base-part in the electronics unit. The electronics unit is advantageously shaped with an external contour, which in its entirety is cylindrically shaped, for which reason the base part is shaped with a side section 14, with a cylindrical enveloping surface which becomes a cylindrical bottom plate 15, on the bottom side of which connectors can be arranged for the connection of the electronics part to other units in, for example, a base station or a microwave link used for, for example telecommunications such as mobile telephony communication, data communication, video communication or other transfer of signals. The substrate in the electronics part 1 can form a supporting structure for analogue/digital electronics such as surface-mounted electronics, microstrip, transmission lines and the like. Said electronics can comprise further laminates. The example shown comprises an electronically controlled switch 18 for the connection of one or several of the antenna elements 5–10 according to certain chosen criteria for transmission and reception in chosen antenna sectors via each transmission circuit 3 in a manner which as such is known. The electrically controlled switch 18 is controlled via a (not shown) control connection.

Figure 4:
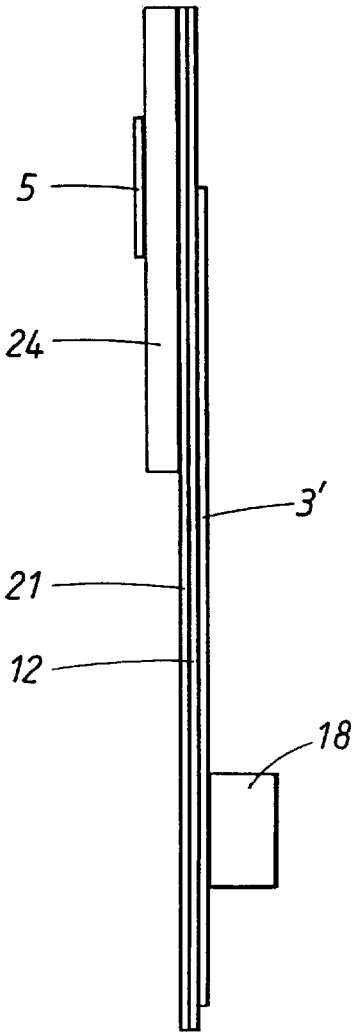
FIG. 4 shows a side-view of the opened electronics unit.
Figure 5:
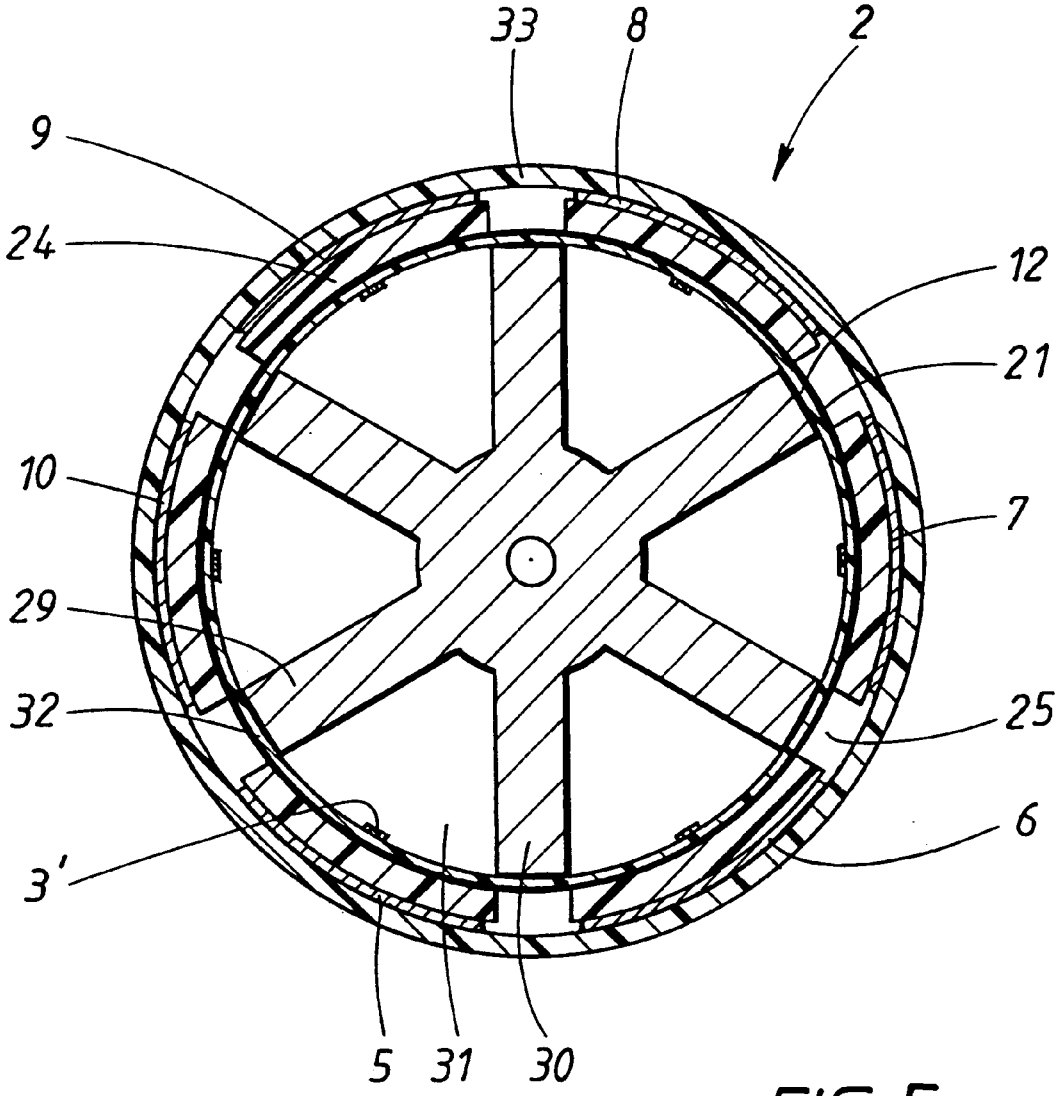
FIG. 5 shows a cross-section through the antenna part in the electronics unit, and FIG. 6 schematically shows the construction of the antenna part.
Figure 6:
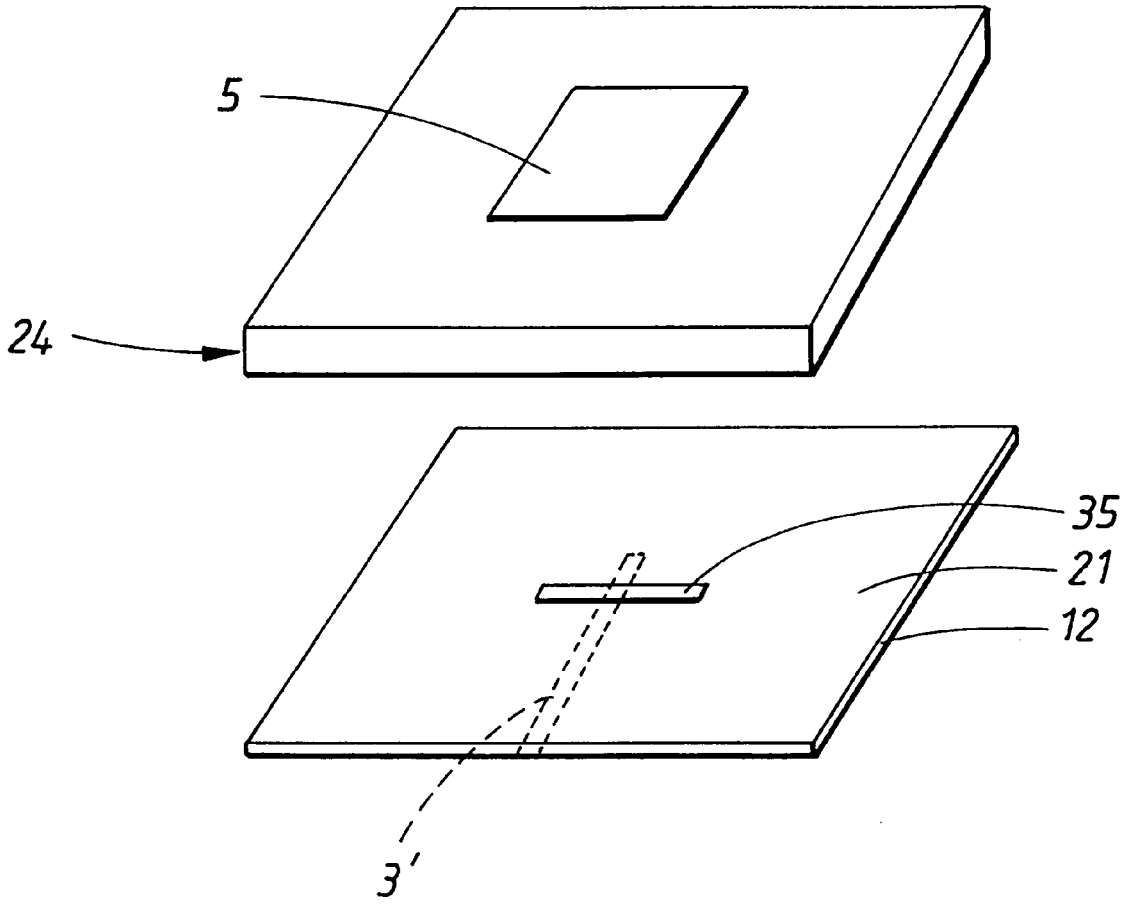

With reference to FIGS. 4, 5 and 6, the construction according to the invention will in the following be described in more detail. As mentioned above, the electronics part 1, the antenna part 2 and the transmission circuit part 3 with the connecting transmission circuits 3', are supported on a continuous common flexible substrate 12, which is manufactured from, for example, a polymer, for example tetrafluorethylene. The laminate also comprises a ground plane 21 across the entire surface of the substrate on one of its sides, and the transmission circuits 3' in the form of microstrip conductors on its other side. In the antenna part, there are arranged sections 24 of a second substrate, to be more exact one section for each antenna element 5. These substrate sections 24 are spaced apart from each other, and on their outside support antenna elements 5–10, for example so-called patches in the form of copper layers which can exhibit a suitable form, for example a rectangular or circular form. The antenna elements can be arranged in groups comprising one or several antenna elements. Due to the curved surface, the groups point in different directions.

Figure 3:
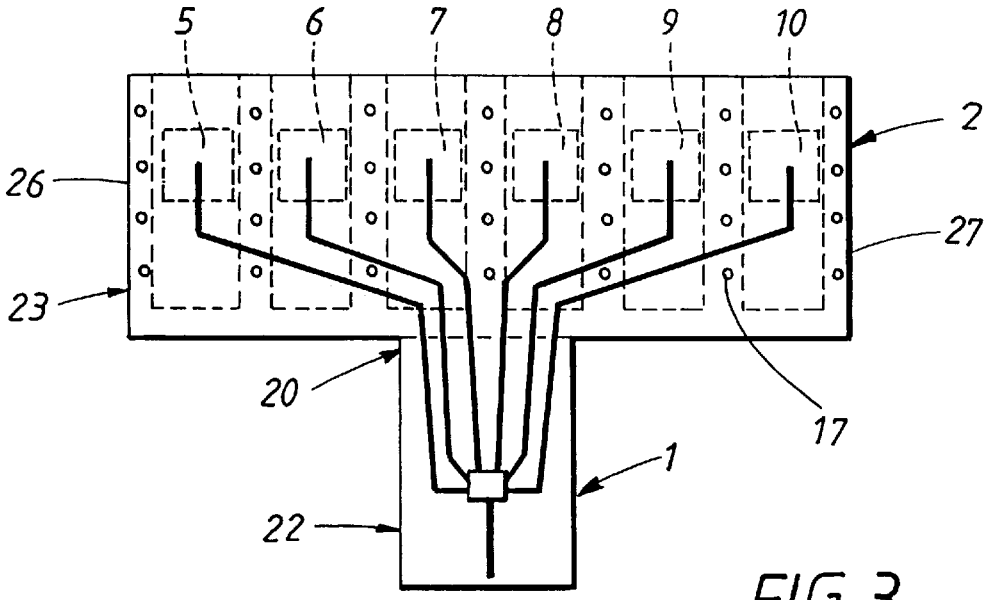
FIG. 3 shows an opened view of the electronics unit.

As can be seen in FIG. 3, the basic part of the common substrate for the electronics part 1, the antenna part 2 and the transmission circuit part 3 is a plane substrate piece, which in the example shown essentially is T-shaped, where a part of the "leg" forms a first part 22 of the substrate which serves as a support for the electronics part, and the cross-bar forms a second part 23 of the substrate, which serves as support for the antenna part 2, and an interface between the first and the second part forms a third part 20 of the substrate, which forms a support for the transmission circuit part 3. The final shape of the antenna part 2 is obtained by bending the cross-bar 23, i.e. the second part with its ground plane and any other layers. In the example shown the cross-bar is bent to a shape which essentially is cylindrically formed. By means of a certain reduced elasticity in the sections 24 of the second substrate, in practice a certain stiffening is obtained of these parts in relation to the intervals 25 which are formed between the sections. Although FIG. 5, for reasons of simplicity, shows only arc-shaped lines, the shape can in practice become polygonal, thus causing essentially plane antenna elements 5–10. The cross-bar 23 of the substrate piece is dimensioned so that the two outer edges 26, 27 will essentially meet, to form a closed convex enveloping surface with a chosen diameter. The ground plane 21 is bent together with the substrate 12, so that it, similarly to the substrate, is given a bent shape. For reasons of simplicity, the ground plane in FIG. 5 is shown as a thick circumferential arc line.

One and the same substrate layer 12 thus forms a continuous supporting structure both for the electronics part 1, the antenna part, and the transmission circuits 3' of the transmission circuit part 3 which extend between them. The ground plane 21 can, similarly to the substrate 20, be considered to consist of three continuous sections in the form of an electrically conducting layer which extends across both the electronics part 1, the antenna part 2 and the transmission circuit part 3. This forms the above-mentioned interface, by means of which the transmission circuits extend from the electronics part 1 and into the antenna part 2, to be more exact one conductor all the way up to a chosen point, at least up to the area of each aperture 35.

As can be seen in FIG. 5, the antenna part 2 exhibits a body 28 of metal which, in the example shown, has six radially extending walls 29, 30 which extend from a center which coincides with the axis of symmetry 11. The body 28, due to its design, delimits a chamber 31 behind each antenna element 5–10. These chambers 31 suppress radiation in the backwards and side directions, both from the antenna elements and from the transmission circuits 3, which reduces the problem of interference between the radiating components. The chambers also form cavities which affect the impedance adjustment of the antenna element. The body 28 has radially outwards facing end surfaces 32, against which the substrate 20 obtains support with its inside. The bent substrate layer can be attached to the end surfaces, for example by means of screws through holes 17, see FIG. 3.

Radially outside of the antenna element 5–10 there is arranged a cover 33, which is tube-shaped and preferably cylindrical, and which is designed in a known manner in a material with low attenuation of electromagnetic waves. The cover 33 forms a radome, and also an outer mechanical support and protection for the substrate part 23 of the antenna part which is bent to a convex shape, and which, if it has elastic properties, thus is contained to the predetermined form due to interaction with the body 28 from the inside. The radome 33 extends in the direction of the longitudinal axis 11, at least enough to cover the height of the substrate part 23. The radome can advantageously exhibit a closed end wall above the antenna part 2, and can also surround the electronics part 1 and the transmission circuit part 3, which however is not shown.

FIG. 6 shows the above-mentioned substrate construction with the first substrate 12, from which it can be seen that the ground plane 21 exhibits oblique slit-shaped openings 35, so-called apertures which, as such, are previously known, and which form radiation elements in order to transfer the microwave energy from the transmission circuits 3 to the antenna element 5, which in turn during transmission radiate in an outwards direction in a chosen sector. During reception, the microwave radiation goes in the opposite direction.

The invention is not limited to the examples of embodiments described above and shown in the figures, but can be varied within the scope of the appended claims. For example, the antenna elements 5–10 can have another shape, or their amount can be larger or smaller. Furthermore, each antenna element can be extended to a group of radiation elements in the same direction, for example to alter the beam-shape in a plane parallel to the cylinder axis 11. Furthermore, the patches, and thus the second substrate 24 are not a necessary condition in order to carry out the invention. In principle, both the body 28 and the radome 33 can be left out.

What is claimed is:

1. An electronics unit for wireless transfer of signals comprising an antenna part, an electronics part which is constructed on a laminate with at least one substrate layer of a dielectric material, and a transmission circuit part with transmission circuits which connect the electronics part to the antenna part, wherein said substrate layer is made from a flexible material, and the substrate layer forms one common continuous unit which comprises a first section which supports said electronics part, a second section which supports said antenna part, and a third section which supports said transmission circuit part, and wherein said second section of the substrate is bent to a curved shape, a convex surface of which supports groups of antennae comprising at least one antenna element each, which groups of antennae point in different directions due to the convex surface.

2. The electronics unit according to claim 1, wherein the antenna part forms an outwardly closed surface.

3. The electronics unit according to claim 2, wherein the antenna part exhibits a substantially cylindrical shape.

4. The electronics unit according to claim 3, wherein the antenna elements are placed around said convex surface so that their beams cover the circumference.

5. The electronics unit according to claim 1, wherein the antenna element and the transmission circuits are designed in microstrip technology.

6. The electronics unit according to claim 5, wherein said substrate supports a ground plane, which continuously extends across the electronics part, the transmission part, and the antenna part.

7. The electronics unit according to claim 6, wherein the antenna part exhibits apertures in the ground plane.

8. The electronics unit according to claim 7, wherein the antenna part exhibits antenna elements positioned outside of the apertures, which antenna elements are in the form of microstrip elements on a second substrate layer.

9. The electronics unit according to claim 4, wherein the second section of said substrate layer is bent around a metal body with radially directed separating walls.

10. The electronics unit according to claim 4, wherein at least the second section of said substrate layer with antenna elements is contained by a substantially cylindrical radome which serves both as mechanical support and as protection for the antenna part.

11. The electronics unit of claim 1, wherein the first, second and third sections are arranged consecutively on the substrate layer.

* * * * *